US010575695B2

(12) United States Patent
Lee et al.

(10) Patent No.: US 10,575,695 B2
(45) Date of Patent: Mar. 3, 2020

(54) VACUUM SUCTIONING UNIT

(71) Applicant: LG ELECTRONICS INC., Seoul (KR)

(72) Inventors: Jeongho Lee, Seoul (KR); Changgun Lee, Seoul (KR); Sangchul Lee, Seoul (KR); Taekyung Kim, Seoul (KR); Younggyu Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 171 days.

(21) Appl. No.: 15/557,723

(22) PCT Filed: Mar. 11, 2016

(86) PCT No.: PCT/KR2016/002430

§ 371 (c)(1),
(2) Date: Sep. 12, 2017

(87) PCT Pub. No.: WO2016/144126

PCT Pub. Date: Sep. 15, 2016

(65) Prior Publication Data

US 2018/0064302 A1 Mar. 8, 2018

(30) Foreign Application Priority Data

Mar. 12, 2015 (KR) ..... 10-2015-0034394

(51) Int. Cl.
*A47L 9/22* (2006.01)
*F04D 29/44* (2006.01)
(Continued)

(52) U.S. Cl.
CPC *A47L 9/22* (2013.01); *A47L 5/12* (2013.01); *A47L 5/22* (2013.01); *A47L 11/40* (2013.01);
(Continued)

(58) Field of Classification Search
CPC ..... A47L 9/22; A47L 5/12; A47L 5/22; A47L 11/40; F04D 17/16; F04D 29/444; F05D 2240/121
See application file for complete search history.

(56) References Cited

U.S. PATENT DOCUMENTS 4,767,285 A * 8/1988 Jyoraku ..... F04D 25/06 415/119
8,152,488 B2 * 4/2012 Fang ..... A47L 5/22 415/208.3

(Continued)

FOREIGN PATENT DOCUMENTS

KR 2012130611 12/2012
WO WO2014130060 8/2014

OTHER PUBLICATIONS

International Search Report in International Application No. PCT/KR2016/002430, dated Jun. 22, 2016, 4 pages (with English translation).

(Continued)

*Primary Examiner* — Dung Van Nguyen
(74) *Attorney, Agent, or Firm* — Fish & Richardson P.C.

(57) ABSTRACT

The vacuum suctioning unit of the present invention includes: a cover provided with an air entrance; an impeller for circulating air that enters the air entrance; a motor provided with a shaft connected to the impeller; a guide device for guiding the flow of air that exits an exit of the impeller; and a motor housing that houses the motor and is provided with an air exit. The guide device includes: a guide body disposed below the impeller; a first guide vane formed on a side surface of the guide body and guiding air discharged from the impeller; and a second guide vane formed on the bottom surface of the guide body and connected to the first guide vane to guide air that is moved by the first guide
(Continued)

vane. The entrance angle of the first guide vane is within the range of 10 to 27 degrees.

11 Claims, 5 Drawing Sheets

(51) Int. Cl.

| | |
|---|---|
| ***A47L 11/40*** | (2006.01) |
| ***F04D 17/16*** | (2006.01) |
| ***A47L 5/22*** | (2006.01) |
| ***A47L 5/12*** | (2006.01) |

(52) U.S. Cl.
CPC ..... *F04D 17/16* (2013.01); *F04D 29/44* (2013.01); *F04D 29/444* (2013.01); *F05D 2240/121* (2013.01)

(56) References Cited

U.S. PATENT DOCUMENTS

| | | | | |
|---|---|---|---|---|
| 9,644,635 | B2 * | 5/2017 | Mizukami | F04D 29/162 |
| 10,125,783 | B2 | 11/2018 | Brownell | |
| 2008/0014080 | A1 | 1/2008 | Fang | |
| 2012/0138058 | A1 * | 6/2012 | Fu | A61M 16/0066 128/204.23 |
| 2014/0241894 | A1 | 8/2014 | Brownell | |

OTHER PUBLICATIONS

European Extended Search Report in European Application No. 16762013.7, dated Oct. 30, 2018, 8 pages.

* cited by examiner

VACUUM SUCTIONING UNIT

CROSS-REFERENCE TO RELATED APPLICATIONS

This application is a National Stage application under 35 U.S.C. § 371 of International Application No. PCT/KR2016/002430, filed Mar. 11, 2016, which claims the benefit of Korean Application No. 10-2015-0034394, filed on Mar. 12, 2015. The disclosures of the prior applications are incorporated by reference in their entirety.

TECHNICAL FIELD

The present invention relates to a vacuum suctioning unit.

BACKGROUND ART

Vacuum suctioning units are generally provided in electric cleaner and used to suction air containing dusts.

A vacuum suction unit is disclosed in Korean Patent Publication No. 2013-0091841 (Published Date: Aug. 20, 2013), which is a prior art document.

The vacuum suction unit includes a motor, an impeller connected to the motor through a rotation shaft to suction air through rotation thereof, and a guide member disposed adjacent to the impeller to guide air discharged from the impeller.

The guide member includes a body part disposed below the impeller, a first guide vane disposed on a side surface of the body part to guide air discharged from the impeller, and a second guide vane disposed on a bottom surface of the body part and connected to the first guide vane to guide the air moving by the guidance of the first guide vane.

In case of the guide member according to the prior art document, the first guide vane is inclinedly disposed to allow air to flow in a direction in which the air discharged from the impeller flows, thereby reducing a flow loss. However, in the even case, the first guide vane has a large entrance angle to cause a problem in flow loss.

DISCLOSURE OF THE INVENTION

Technical Problem

An object of the prevent invention is to provide a vacuum suctioning unit in which an entrance angle of a guide vane is optimized to minimize a flow loss.

Technical Solution

To achieve the above object, a vacuum suctioning unit according to the present invention includes: a cover provided with an air entrance; an impeller for allowing air introduced through the air entrance to flow; a motor provided with a shaft connected to the impeller; a guide device for guiding a flow of air discharged through an exit of the impeller; and a motor housing accommodating the motor and provided with an air exit, wherein the guide device includes: a guide body disposed below the impeller; a first guide vane disposed on a side surface of the guide body to guide the air discharged from the impeller; and a second guide vane disposed on a bottom surface of the guide body and connected to the first guide vane to guide air moving by the first guide vane, wherein an entrance angle of the first guide vane ranges of 10 degrees to 27 degrees.

The vacuum suctioning unit may further include a motor bracket defining a passage, through which air flows, together with the guide body, wherein at least a portion of the second guide vane may be disposed outside the passage.

The motor bracket may include: a bracket body for defining the passage; a supporter for supporting the guide boy; and a connection part connecting the bracket body to the supporter, wherein the supporter may have a bottom surface higher than that of the second guide vane.

At least a portion of the second guide vane may have a vertical length that gradually increases to the shaft of the motor.

Each of at least a portion of the second guide vane disposed in the passage and at least a portion of the second guide vane disposed outside the passage may have a vertical length that gradually increases to the shaft.

The vacuum suctioning unit may further include a flow guide guiding the air guided by the second guide vane to the motor.

The flow guide may be coupled to a supporter of the motor bracket.

The flow guide may have a guide surface that is rounded or inclined.

Advantageous Effects

According to the proposed invention, since the entrance angle of the first guide vane disposed on the side surface of the guide body is selected in the range of 10 degrees to 27 degrees, the flow loss of air may be minimized to maximize the fan efficiency.

Also, since at least a portion of the second guide vane disposed on the bottom surface of the guide body is disposed outside the second passage defined by the guide bar and the motor bracket, the flow guide distance of air may increase so that the air is sufficiently guided to the flow guide.

Also, since at least a portion of the second guide vane has the vertical length that gradually increases to the shaft, the guide area of air may increase to guide the air so as to be sufficiently guided to the glow guide.

MODE FOR CARRYING OUT THE INVENTION

Figure 1:
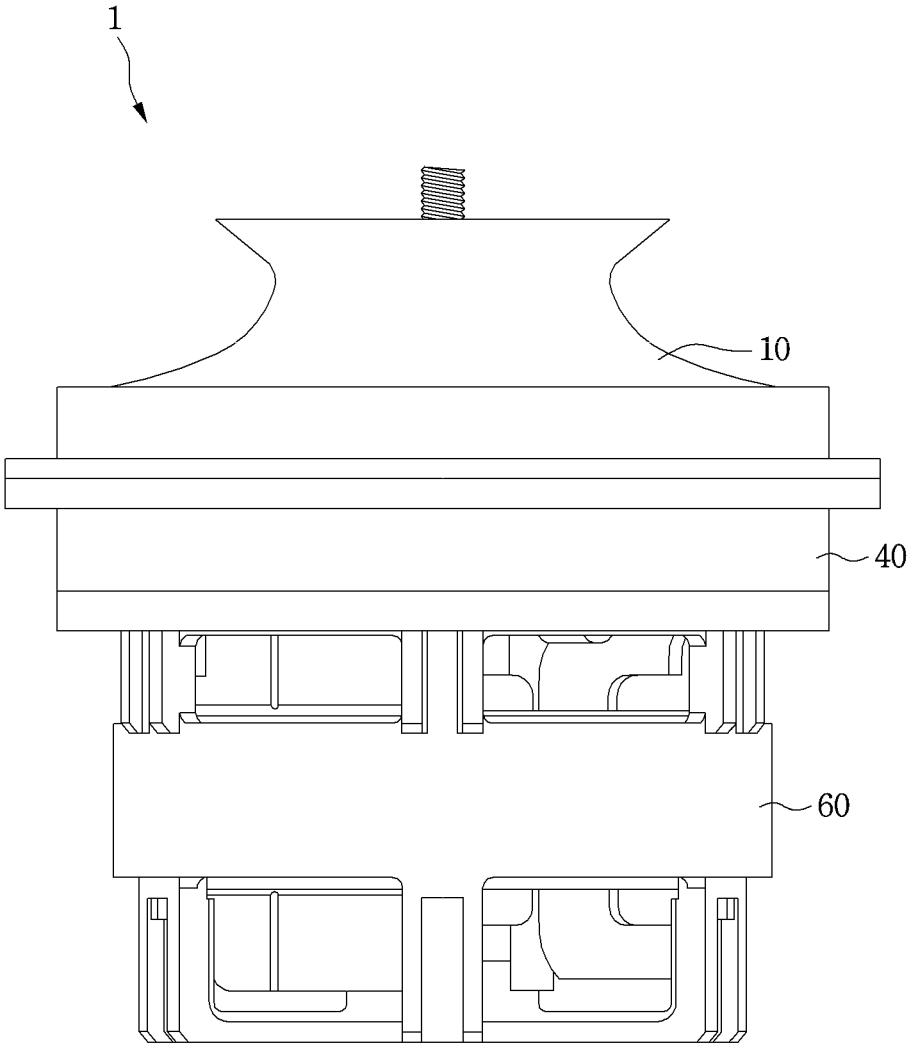
FIG. 1 is a front view of a vacuum suctioning unit according to an embodiment of the present invention.

Hereinafter, exemplary embodiments of the present invention will be described in more detail with reference to the accompanying drawings. It is noted that the same or similar components in the drawings are designated by the same reference numerals as far as possible even if they are shown in different drawings. Also, in the following description of the present invention, a detailed description of known functions and configurations incorporated herein will be omitted to avoid making the subject matter of the present invention unclear.

Also, in the description of the elements of the present invention, the terms first, second, A, B, (a), and (b) may be used. However, since the terms are used only to distinguish an element from another, the essence, sequence, and order of the elements are not limited by them. When it is described that an element is "coupled to", "engaged with", or "connected to" another element, it should be understood that the element may be directly coupled or connected to the other element but still another element may be "coupled to", "engaged with", or "connected to" the other element between them.

Figure 2:
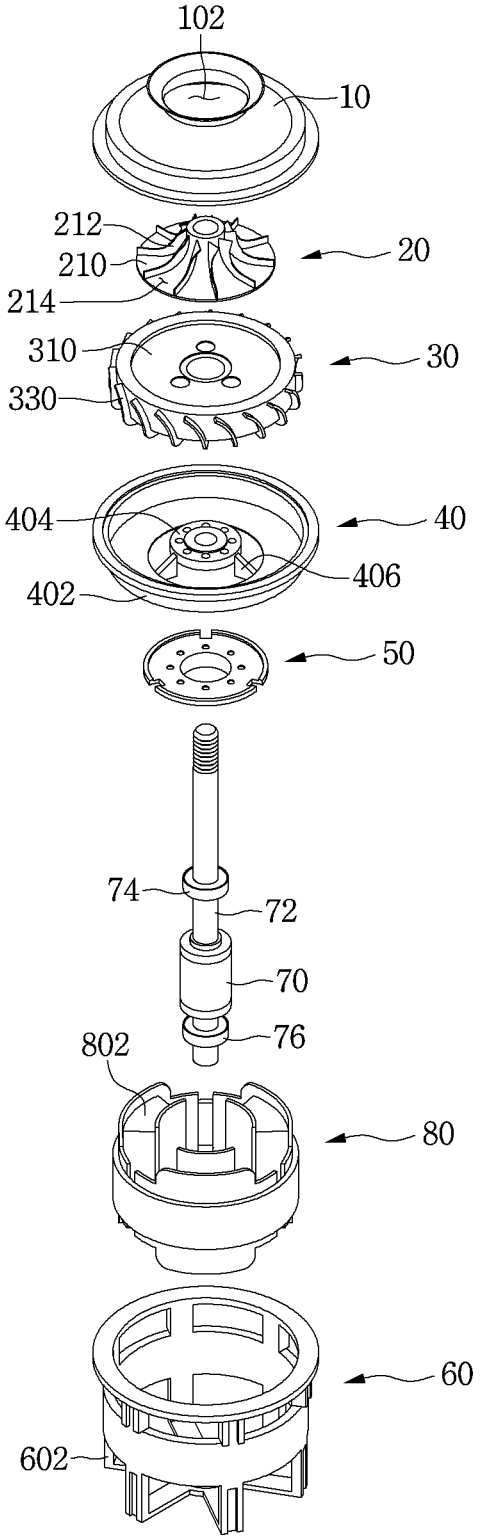
FIG. 2 is an exploded perspective view of the vacuum suctioning unit of FIG. 1.
Figure 3:
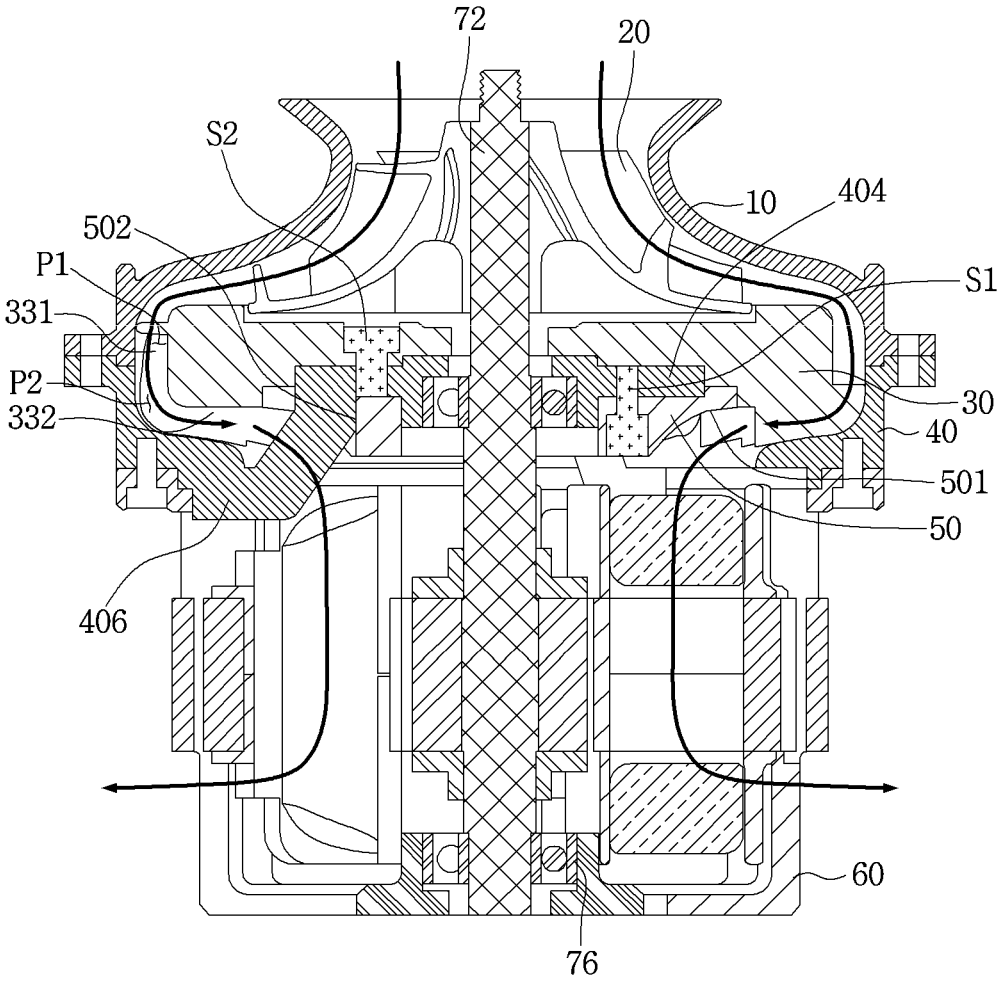
FIG. 3 is a longitudinal cross-sectional view of the vacuum suctioning unit of FIG. 1.

FIG. 1 is a front view of a vacuum suctioning unit according to an embodiment of the present invention, FIG. 2 is an exploded perspective view of the vacuum suctioning unit of FIG. 1, and FIG. 3 is a longitudinal cross-sectional view of the vacuum suctioning unit of FIG. 1.

Referring to FIGS. 1 to 3, a vacuum suctioning unit 1 according to an embodiment of the present invention may include a cover 10 having an air entrance and a motor housing 60 having one or more air exits 602.

For a smooth flow of air, the plurality of air exits 602 may be provided in the motor housing 60.

The vacuum suctioning unit 1 may further include a motor bracket 40 coupled to the cover 10.

For example, the motor bracket 40 may be disposed between the cover 10 and the motor housing 60 and then be coupled to each of the cover 10 and the motor housing 60.

For example, the motor bracket 40 may be coupled to a lower portion of the cover 10, and the motor housing 60 may be coupled to a lower portion of the motor bracket 40. Here, the present invention is not limited to the coupled position.

The vacuum suctioning unit 1 may further include an impeller 20. The impeller 20 may be accommodated in the cover 10.

The cover 10 may guide air introduced through the air entrance 102 to the impeller 20. Also, the cover 10 may isolate an inner space from an external atmosphere to maintain a vacuum pressure.

The impeller 20 may increase static pressure energy and dynamic pressure energy of the air introduced through the air entrance 102. A flow rate of air may increase by the impeller 20.

For example, the impeller 20 may include a hub 210 and a plurality of impeller blades 212 disposed on the hub 210.

The vacuum suctioning unit 1 may further include a guide device for guiding a flow of air discharged through the exits 214 of the impeller 20.

The guide device 30 converts dynamic pressure energy of energy components of the air discharged through the exits 214 of the impeller 20 into static pressure energy. That is, the guide device 30 may reduce the flow rate of a fluid to increase the static pressure energy.

At least a portion of the guide device 30 may be disposed in the cover 10, and the impeller 20 may be disposed above the guide device 30.

The guide device 30 may include a guide body 310 and a plurality of guide vanes 330 disposed around the guide body 310.

For example, the guide body 310 may have a cylindrical shape, and the plurality of guide vanes 330 may be spaced apart from each other in a circumferential direction of the guide body 310.

The motor bracket 40 may include a bracket body 402, a supporter 404 disposed in an internal region of the bracket body 402, and a connection part 406 connecting the bracket body 402 to the supporter 402.

A portion of the motor bracket 40 may be disposed at a side of the plurality of guide vanes 330, and the other portion may be disposed below the plurality of guide vanes 330.

The supporter 404 may support the guide device 30. For example, the guide body 310 may be seated on the supporter 404. A portion of the supporter 404 may be accommodated in the guide body 310.

In the state in which the guide body 310 is seated on the supporter 404, an outer surface of the guide body 310 may be spaced apart from an inner surface of the cover 10. Thus, a first passage P1 through which air flows may be provided between the outer surface of the guide body 310 and the inner surface of the cover 10.

In the state in which the guide body 310 is seated on the supporter 404, the outer surface of the guide body 310 may be spaced apart from the bracket body 402. Thus, a second passage P2 through which air flows may be provided between the outer surface of the guide body 310 and the bracket body 402.

At least a portion of the guide body 310 may be disposed between the supporter 404 and the bracket body 402 in the state of being seated on the supporter 404. That is, at least a portion of the guide device 30 may be accommodated in the motor bracket 40.

The plurality of guide vanes 330 may be disposed in the first passage P1 and the second passage P2 to guide a flow of air.

One or more vanes of the plurality of guide vanes 330 may come into contact with the bracket body 402 in the state in which the guide body 310 is seated on the supporter 404.

The vacuum suctioning unit 1 may further include a motor for rotating the impeller 20.

The motor may be accommodated in the motor housing 60. Thus, the motor may be disposed below the supporter 404.

The motor may include a stator 80, a rotor 70 rotating with respect to the stator 80, and a shaft 72 connected to the rotor 70.

The stator 80 may include a coil 802. Although not limited thereto, the rotor 70 may be disposed inside the stator 80. The rotor 70 may include a permanent magnet.

One or more bearings 74 and 76 may be coupled to the shaft 72.

The one or more bearings 74 and 76 may include an upper bearing 74 and a lower bearing 76. The upper bearing 74 may be disposed above the rotor 70, and the lower bearing 74 may be disposed below the rotor 70.

The upper bearing 72 may be supported by the supporter 404 of the motor bracket 40. For example, at least a portion of the upper bearing 74 may be accommodated in the supporter 404. Although is not limited thereto, the upper bearing 74 may be inserted into the supporter 404 from a lower side of the supporter 404.

The motor housing 60 may support the lower bearing 76.

The vacuum suctioning unit 1 may further include a flow guide 50 for guiding air guided by the guide vane 330 to the stator 80.

The flow guide 50 may prevent the air guided by the guide vane 330 to flowing to the shaft 72. That is, the flow guide 50 may change the flow direction of air to guide the air so that the air does not flow in a horizontal direction that is perpendicular to an extension direction of the shaft 72, but flows downward.

Thus, the flow guide 50 may include a guide surface that is rounded or inclined. At least a portion of the flow guide 50 may have a diameter that gradually decreases downward.

The flow guide 50 may be coupled to the supporter 404 of the motor bracket 40 by a first coupling member S1. Also, the guide device 30 may be coupled to the supporter 404 by a second coupling member S2.

At least a portion of the supporter 404 may be inserted into the flow guide 50.

To prevent an interference with the connection part 406, the flow guide 50 may include an opening 502 through which the connection part 406 passes.

The shaft 72 may pass through the motor bracket 40 and the guide device 30 and then be coupled to the impeller 20. For example, the shaft 72 may pass through the supporter 404 and the guide body 310.

An air flow in the vacuum suctioning unit 1 will be briefly described.

When power is applied to the vacuum suctioning unit 1, the motor is driven. As a result, the rotor 70 rotates with respect to the stator 80, and then, the shaft 72 coupled to the rotor 70 rotates. When the shaft 72 rotates, the impeller 20 connected to the shaft 72 rotates.

Air outside the vacuum suctioning unit 1 is introduced into the cover 10 through the air entrance 102 by the impeller 20. The air introduced into the cover 10 flows along the impeller 20.

The air discharged from the exits 214 is guided by the cover 10 to flow to the guide vane 330 of the guide device 30. Then, the air flows along the first passage P1 and the second passage P2. In this process, the guide vane 330 guides a flow of the air.

The air passing through the second passage P2 is switched in direction by the flow guide 50 to flow downward. A portion of the air passing through the second passage P2 does not pass through the motor, but is discharged through a portion of the plurality of air exits 602 of the motor housing 60. Also, the other portion of the air passes through the motor and then is discharged through the other of the plurality of air exits 602 of the motor housing 60.

Figure 4:
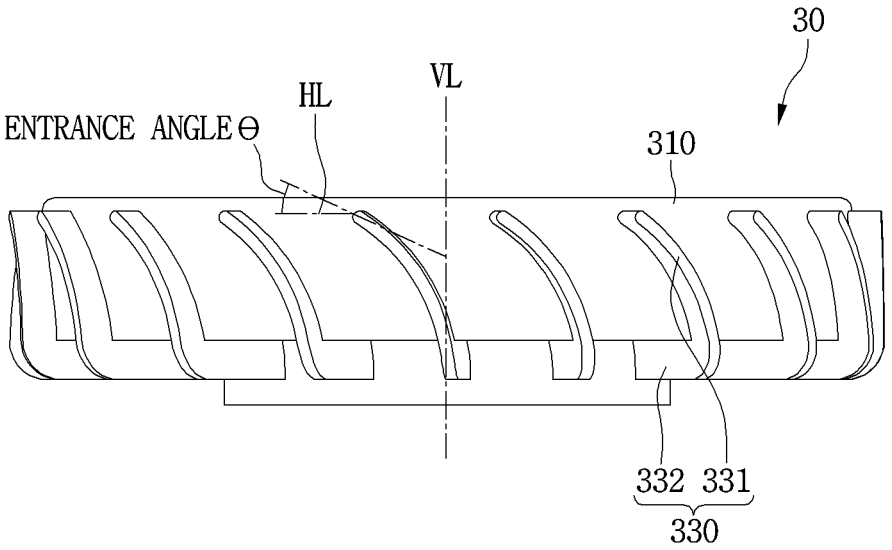
FIG. 4 is a view of a guide vane according to an embodiment of the present invention.
Figure 5:
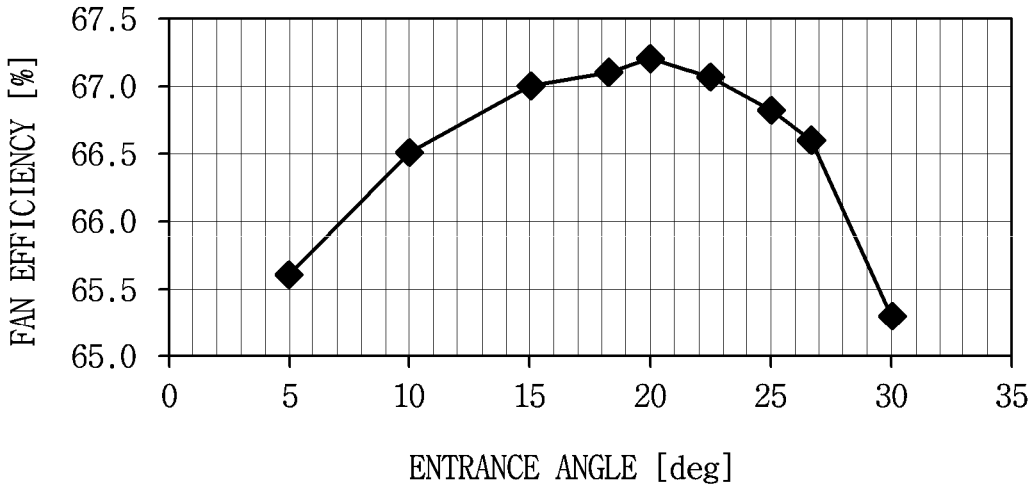
FIG. 5 is a graph illustrating efficiency depending on an entrance angle of the guide vane.

FIG. 4 is a view of a guide vane according to an embodiment of the present invention, and FIG. 5 is a graph illustrating efficiency depending on an entrance angle of the guide vane.

Referring to FIGS. 3 to 5, an entrance angle θ of the guide vane 330 represents an angle defined by an extension line extending in the extension direction of a portion, at which the air discharged from the guide vane 330 through the exits 214 of the impeller 20 and a horizontal line HL.

In this embodiment, an entrance angle of the guide vane 330 may be less than 90 degrees. That is, at least a portion of the guide vane 330 may be disposed to be inclined at a predetermined angle with respect to a vertical line VL (that is an extension line extending in parallel to the extension direction of the shaft).

Referring to FIG. 5, when an entrance angle of the guide vane 330 ranges of 10 degrees to 27 degrees, it is seen that the fan efficiency is above a proper level.

When an entrance angle of the guide vane 330 is less than 10 degrees, the guide vane 330 does not serve to guide the flow of air, but rather acts as flow resistance to increase a flow loss, which is not preferable.

Also, when an entrance angle of the guide vane 330 exceeds 27 degrees, the guide vane 330 may not substantially perform the guiding operation, and thus, the flow loss may increase.

Thus, in this embodiment, an entrance angle of the guide vane 330 may be selected within a range of 10 degrees to 27 degrees.

In the abovementioned prior art document, the entrance angle of the first guide vane is approximately 40 degrees. In this embodiment, the fan efficiency may be significantly improved when compared to that of the prior art document.

The guide vane 330 may include a first guide vane 331 disposed on the side surface of the guide body 310 and a second guide vane 332 extending from the first guide vane 331 and disposed on the bottom surface of the guide body 310.

The first guide vane 331 may be disposed in the first passage P1 and the second passage P2, and the second guide vane 332 may be disposed in the second passage P2.

The first guide vane 331 may extend in a vertical direction, and the second guide vane 332 may extend in a horizontal direction. Since the second guide vane 332 is disposed on the bottom surface of the guide body 310, a length for guiding a flow of air may increase.

Here, the supporter 404 may have a bottom surface higher than that of the second guide vane 332 so that the supporter 404 does not act as flow resistance of air guided by the second guide vane 332.

A portion of the second guide vane 332 may be disposed outside the second passage P2. Thus, air passing through the second passage P2 may be guided by the second guide vane 332.

Also, at least a portion of the second guide vane 332 may have a vertical length that gradually increases to the shaft 72. In this case, a guide area of air in the second guide vane 332 may increase to allow the air to smoothly flow to the flow guide 50.

For example, at least a portion of the second guide vane 332 disposed in the second passage P2 may have a vertical length that gradually increases to the shaft 72. Also, at least a portion of the second guide vane 332 disposed outside the second passage P2 may have a vertical length that gradually increases to the shaft 72.

At least a portion of the second guide vane 332 may be disposed at the same height as that of at least a portion of the guide surface 501 of the flow guide 50.

In this embodiment, at least a portion of the first guide vane 331 may be disposed to be inclined with respect to the vertical line VL, and an entrance angle of the first guide vane 331 may be selected within the range of 10 degree to 27 degrees.

According to this embodiment, at least a portion of the guide vane may be disposed to be inclined with respect to the vertical line VL, and the entrance angle of the guide vane may be selected within the range of 10 degrees to 27 degrees to minimize the flow loss of air, thereby improving the fan efficiency.

Although all components according to the embodiment of the present invention have been described as being coupled to each other or operating to be coupled to each other in one body, the present invention is not limited to this embodiment. That is, one or more components are selectively coupled and operated within the scope of the present disclosure. The terms "comprising," "including," and "having," as used in the claims and specification herein, shall be considered as indicating an open group that may include other elements not specified. Unless terms used in the present disclosure are defined differently, the terms may be construed as meaning known to those skilled in the art. Terms such as terms that are generally used and have been in dictionaries should be construed as having meanings matched with contextual meanings in the art. In this description, unless defined clearly, terms are not ideally, excessively construed as formal meanings.

The above-disclosed subject matter is to be considered illustrative, and not restrictive, and the appended claims are intended to cover all such modifications, enhancements, and other embodiments, which fall within the true spirit and scope of the present disclosure. Thus, the embodiment of the present invention is to be considered illustrative, and not restrictive, and the technical spirit of the present invention is not limited to the foregoing embodiment. Therefore, the scope of the invention is defined not by the detailed description of the invention but by the appended claims, and all differences within the scope will be construed as being included in the present disclosure.

The invention claimed is:

1. A vacuum suctioning unit comprising:

a cover provided with an air entrance;

an impeller to allow air introduced through the air entrance to flow;

a motor provided with a shaft connected to the impeller;

a guide device to guide a flow of air discharged through an exit of the impeller; and a motor housing to accommodate the motor and provided with an air exit, wherein the guide device comprises:

a guide body disposed below the impeller;

a first guide vane disposed on a side surface of the guide body to guide the air discharged from the impeller; and a second guide vane disposed on a bottom surface of the guide body and connected to the first guide vane to guide air moving by the first guide vane, wherein an entrance angle of the first guide vane ranges of 10 degrees to 27 degrees, and wherein the entrance angle of the first guide vane represents an angle defined by a horizontal line (HL) and an extension line extending in an extension direction from a point at which air discharged from the first guide vane exits the impeller.

2. The vacuum suctioning unit of claim 1, further comprising a motor bracket to define a passage, through which air flows, together with the guide body, wherein at least a portion of the second guide vane is disposed outside the passage.

3. The vacuum suctioning unit of claim 2, wherein the motor bracket comprises:

a bracket body to define the passage;

a supporter to support the guide body; and a connection part to connect the bracket body to the supporter, wherein the supporter has a bottom surface higher than that of the second guide vane.

4. The vacuum suctioning unit of claim 2, wherein at least a portion of the second guide vane has a vertical length that gradually increases to the shaft of the motor.

5. The vacuum suctioning unit of claim 2, wherein each of at least a portion of the second guide vane disposed in the passage and at least a portion of the second guide vane disposed outside the passage has a vertical length that gradually increases to the shaft.

6. The vacuum suctioning unit of claim 2, further comprising a flow guide to guide the air guided by the second guide vane to the motor.

7. The vacuum suctioning unit of claim 6, wherein the flow guide is coupled to a supporter of the motor bracket.

8. The vacuum suctioning unit of claim 6, wherein the flow guide has a guide surface that is rounded or inclined.

9. The vacuum suctioning unit of claim 8, wherein at least a portion of the second guide vane is disposed at a same height as that of at least a portion of the guide surface of the flow guide.

10. The vacuum suctioning unit of claim 2, wherein at least a portion of the first guide vane is disposed to be inclined at a predetermined angle with respect to a vertical line (VL).

11. The vacuum suctioning unit of claim 2, wherein the first guide vane extends in a vertical direction, and the second guide vane extends in a horizontal direction.

* * * * *